US008579540B2

(12) United States Patent
Lafont

(10) Patent No.: US 8,579,540 B2
(45) Date of Patent: Nov. 12, 2013

(54) ACCESS CONTROL DEVICE INCLUDING A RETRACTABLE OBSTACLE

(75) Inventor: Jean-Bernard Lucien Jules Lafont, Camaret/Aigues (FR)

(73) Assignees: Jean-Bernard Lucien Jules Lafont, Camaret/Aigues (FR); Alexandre M. Rothschild, Port Washington, NY (US)

( * ) Notice: Subject to any disclaimer, the term of this patent is extended or adjusted under 35 U.S.C. 154(b) by 0 days.

(21) Appl. No.: 13/410,763

(22) Filed: Mar. 2, 2012

(65) Prior Publication Data

US 2012/0230764 A1 Sep. 13, 2012

(30) Foreign Application Priority Data

Mar. 11, 2011 (FR) ..... 11 00738

(51) Int. Cl.
*E01F 9/019* (2006.01)

(52) U.S. Cl.
USPC ..... 404/11; 404/6

(58) Field of Classification Search
CPC ..... E01F 9/073
USPC ..... 404/6, 9, 11
See application file for complete search history.

(56) References Cited

U.S. PATENT DOCUMENTS

| | | | | | |
|---|---|---|---|---|---|
| 1,797,498 | A * | 3/1931 | Finley | 404/11 |
| 2,063,263 | A * | 12/1936 | Murphy | 404/11 |
| 4,332,503 | A * | 6/1982 | Hurst, Jr. | 404/11 |
| 4,576,508 | A * | 3/1986 | Dickinson | 404/6 |
| 5,059,060 | A * | 10/1991 | Steinhardt | 404/11 |
| 6,848,856 | B2 * | 2/2005 | Johnson | 404/6 |
| 8,226,322 | B2 * | 7/2012 | Blair | 404/11 |

FOREIGN PATENT DOCUMENTS

| | | |
|---|---|---|
| EP | 0 945 550 A2 | 9/1999 |
| FR | 2 690 175 A1 | 10/1993 |
| NL | 9 200 316 A | 9/1993 |

* cited by examiner

*Primary Examiner* — Raymond W Addie
(74) *Attorney, Agent, or Firm* — Ladas & Parry LLP

(57) ABSTRACT

The invention relates to an access control device (20) comprising a first housing (21), an obstacle (25) mounted to move in translation in the first housing, a second housing (23) remote (34) from the first housing and receiving an electric motor-and-gearbox unit (26), a deformable link connected to the obstacle and co-operating with the unit, and a mechanical return device for returning the obstacle towards a position projecting out from the first housing, which return device is connected to the deformable link and is arranged in the second housing.

20 Claims, 10 Drawing Sheets

ACCESS CONTROL DEVICE INCLUDING A RETRACTABLE OBSTACLE

TECHNICAL FIELD

The present invention relates to an access control device including an obstacle—such as a bollard—that is retractable into the ground.

The invention applies in particular to the retractable bollards that are used to allow or prevent vehicles accessing a residential, service-sector, or urban zone.

STATE OF THE ART

The invention applies in particular to bollards comprising a housing for burying in the ground, a structure that acts as an obstacle and that is mounted to move in (vertical) translation within the housing, a rotary electric motor, and a deformable link—such as a cable, a strap, a belt, or a roller chain—connecting the structure that acts as an obstacle to the motor so as to enable said structure to be moved in translation under drive from rotation of the motor.

Such bollards are described in particular in patent EP 0 627 527 in which the deformable link is driven by a sprocket or by a drum driven by the motor via a reversible speed-reducing gearbox, such that in the event of the power supply to the motor being interrupted, the structure that acts as an obstacle moves down under gravity towards the bottom of the housing.

In such a device where the motor forms part of movable equipment that moves in vertical translation and that includes the bollard that acts as an obstacle, moving and stopping the bollard give rise to impacts and to vibration that are applied to the motor and that accelerate its aging.

Furthermore, when the bollard is deployed so as to project above the ground, and when an impact is applied thereto, a fraction of the energy of the impact is transmitted to the casing, to the motor, and to the other electromechanical components for driving the bollard, as well as to the associated sensors, and that can damage the motor, those electromechanical components, and/or the sensors.

Other bollards driven by means of a strap that is wound onto a drum are described in patents EP 0 945 550, FR 2 869 629, and WO 2006/024787. In an embodiment described in patent EP 0 945 550 as being advantageous for solid or small-diameter bollards and obstacles, the motor-and-gearbox unit is placed in a housing external to the housing for the bollard.

Patent AU 2004/100095 describes a retractable bollard that is not motor driven, and having a housing made up of three compartments: a central compartment that receives the element acting as the retractable obstacle, and two side compartments, each receiving a counterweight.

Since the combined weight of the counterweights balances the weight of the element acting as an obstacle, little force is required on the element acting as an obstacle in order to deploy it or retract it.

One drawback of manually-driven bollards is that they cannot be remotely controlled; another drawback is that they can easily be retracted by an ill-intentioned person.

A drawback of bollards driven by a rotary electrical actuator is that they are fragile and require frequent and expensive maintenance.

A drawback of retractable bollards is that they cannot withstand impacts of energy exceeding a few tens of thousands of joules (J). Unfortunately, certain "security" applications require a retractable bollard to withstand an impact of energy that may reach or exceed $10^5$ J or $10^6$ J.

Another drawback of retractable bollards is that in order to renovate the coating of the structure that acts as an obstacle, which coating is subjected to various kinds of attack (moisture, friction, impacts, etc.), it is generally necessary for the structure to be disassembled and extracted, and then subjected to lengthy and expensive treatment in a workshop specialized for that purpose.

In particular when the coating is paint and when the wall of the structure, which is generally tubular and made of cast iron or steel, is also thick, the surface appearance of the structure is not very attractive, in particular because of irregularities (projections or indentations) of said surface that result from the method used for fabricating the structure. That is why such structures are generally machined in order to improve their surface state, thereby giving rise to significant extra cost.

SUMMARY OF THE INVENTION

An object of the invention is to propose an access control device including a retractable obstacle that withstands high levels of impact.

An object of the invention is to propose an access control device including a retractable obstacle and for which maintenance is reduced, made easier, and/or inexpensive.

An object of the invention is to propose an access control device including a retractable obstacle, which device is improved and/or remedies, at least in part, the shortcomings or drawbacks of known access control devices.

According to an aspect of the invention, there is provided an access control device comprising a first housing, an obstacle mounted to move in translation inside the first housing, a second housing remote from the first housing and receiving an electrical motor-and-gearbox unit, (at least) one deformable link connected to the obstacle and co-operating (in particular by meshing or by winding) with the motor-and-gearbox unit, and a mechanical return device for returning the obstacle towards a position projecting out from the first housing, which return device is connected to the deformable link and is arranged in the second housing, such that the deformable link(s) transmit(s) the return force exerted by the mechanical return device to the obstacle, together with the drive force exerted by the motor-and-gearbox unit.

In other words, and according to another aspect of the invention, there is provided an access control device comprising a first housing for burying in the ground, an obstacle slidably mounted in the first housing, a second housing for burying in the ground, a rotary electric motor fitted with a speed-reducing gearbox and arranged in the second housing, a deformable link connected to the obstacle and driven by the motor-and-gearbox unit, a hollow structure extending between the first and second housings and having a portion of the deformable link extending therein, and a mechanical return device for returning the obstacle towards a position projecting out from the first housing, which return device is connected to the deformable link and is arranged in the second housing.

According to another aspect of the invention, there is provided an access control device comprising a first buried housing, a bollard slidably mounted in the first housing to slide along the substantially vertical longitudinal axis of said housing, a second buried housing separated from the first housing by a dissipative structure—such as a layer of concrete—serving to diminish the transmission to the second housing of the energy of an impact against the bollard acting as an obstacle, a rotary electric motor fitted with a reversible speed-reducing gearbox and arranged in the second housing, a deformable link connected to the obstacle and driven by the motor-and-gearbox unit, a hollow structure interconnecting the respective top portions of the first and second housings and having a (central) portion of the deformable link extending therein—and capable of moving therein—, a mechanical return device for returning the obstacle into or towards a position projecting out from the first housing, which return device is connected to the deformable link and is arranged in the second housing, and a power supply for powering the electric motor, the power supply including an electrical energy storage device such as a battery.

In the event of an impact against the projecting portion of the obstacle, the invention serves to limit or to avoid the energy of the impact being transmitted to the second housing and to the members and equipment contained therein.

The invention makes it easier to install, maintain, and repair the components of the access control device.

The assistance given by the mechanical return device to sliding the obstacle makes it possible to use a motor of lower power, while still enabling the bollard to be moved quickly.

The invention also makes it possible to continue deploying and retracting the bollard after the power supply to the access control device has been cut in the event of the device incorporating an electrical energy storage device, thereby making it possible, until the energy stored in the storage device has been used up, to hold the obstacle in a predetermined position (deployed or retracted).

In embodiments of the invention:

- the access control device may comprise two deformable links, in particular two roller chains, each fastened to the slidable obstacle at a first one of its two ends and fastened to the mechanical return device at a second one of its two ends, and each engaging a drive member—such as a sprocket—that is driven in rotation by the motor-and-gearbox unit;
- when the slidable obstacle comprises a cylindrical body of circular section, the two deformable links may be fastened to respective points or regions thereof that are diametrically opposite;
- the slidable obstacle may comprise a tubular body (a cylindrical body of circular section) provided with at least one piece of reinforcement projecting from the outside face of the tubular body and extending over (at least) a substantial fraction of a circumference of the tubular body, in particular reinforcement in the form of a flange, a rim, or a ring surrounding the tubular body and extending to a short distance from the inside face of the first housing; such that in the event of an impact against the portion of the obstacle that projects out from the housing, the reinforcement can bear against the inside face of the housing so that the housing and the material surrounding the housing contribute to withstanding the impact; for this purpose, and in a particular embodiment, the tubular body of the obstacle may be provided with a first annular piece of reinforcement arranged at the bottom end of the tubular body and with a second annular piece of reinforcement arranged above the first piece of reinforcement at a distance therefrom that may be not less than about half the diameter of the tubular body, e.g. a distance equal to about the diameter of the tubular body;
- the mechanical return device for returning the obstacle into (or towards) a position projecting out from the first housing may comprise a heavy structure serving as a counterweight for balancing at least a fraction of the weight of the slidable obstacle; the heavy structure may present a weight that is greater than that of the slidable obstacle, e.g. by at least 5% or 10%, or on the contrary a weight that is less than the weight of the slidable obstacle, e.g. by at least 5% or 10%; the heavy structure may comprise two heavy sub-structures of unequal respective weights that are connected together by an electromagnetic connection member such as an electromagnet;
- the mechanical return device for returning the obstacle into (or towards) a position for projecting out from the first housing may comprise, in addition to or as a replacement for the heavy structure(s), one or more springs, in particular one or more helical springs each having a first end fastened to the wall of the second housing and a second end fastened to an end of a respectively deformable link;
- the slidable obstacle may comprise a tubular body and an end wall—or cap—closing the top end of the tubular body and releasably fastened to the tubular body, thereby making the first housing easier to clean; and
- each of the housings may be fitted with jacks in its bottom portion so as to make it easier to put the top ends of the housings in a horizontal position.

According to another aspect of the invention, there is provided an access control device comprising a housing, an obstacle mounted to move in translation in the housing, an actuator such as an electric motor-and-gearbox unit, a deformable link connected to the obstacle and co-operating with the actuator to move the obstacle in the housing, and a translucent film covering at least a (substantial) portion of the outside surface of the obstacle and secured to the obstacle in reversible manner. The film may be secured to the tubular outside surface of the obstacle by adhesion, in particular by adhesive. The face of the film that is secured to the obstacle may be provided with patterns that can be seen visually. For this purpose, the patterns may be obtained by silkscreen printing. The film may be essentially constituted by polyester; it may present thickness lying in the range going from approximately 50 micrometers (μm) to approximately 100 μm or 200 μm.

Other aspects, characteristics, and advantages of the invention appear from the following description that refers to the accompanying figures that show preferred embodiments of the invention, in non-limiting manner.

BRIEF DESCRIPTION OF THE FIGURES

in FIG. 4 the obstacle is retracted inside the first housing; in FIG. 5 the obstacle is fully deployed outside the housing; and in FIG. 6 there can be seen a configuration that is intermediate between the configurations of FIGS. 4 and 5.

DETAILED DESCRIPTION OF THE INVENTION

Unless indicated explicitly or implicitly to the contrary, elements or members that are structurally or functionally identical or similar are designated by identical references in the various figures.

Figure 10:
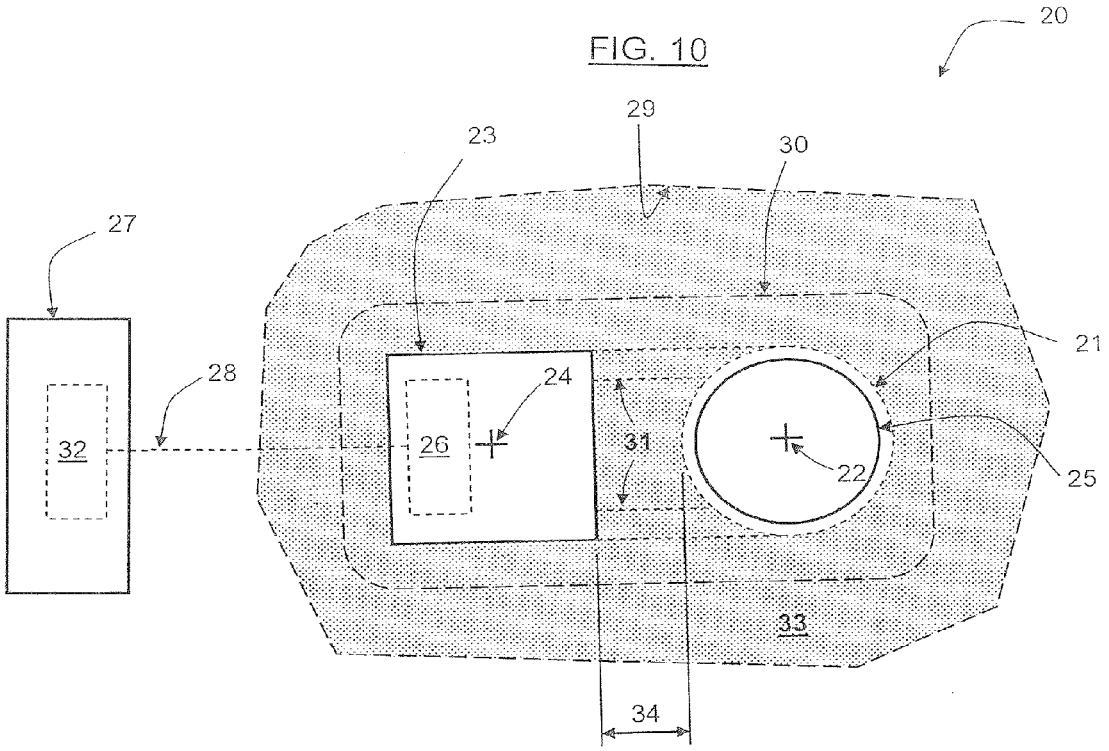
FIG. 10 is a diagrammatic plan view of a buried access control device.

With reference to FIG. 10 in particular, the access control device 20 comprises a first housing 21 of tubular shape with a circular cross-section and having its longitudinal axis 22 arranged substantially vertically.

The device 20 also has a second housing 23 of tubular shape, of rectangular or square cross-section, with its longitudinal axis 24 arranged substantially vertically.

The housing 21 contains an obstacle 25 in the form of a bollard that is mounted to slide along the axis 22, while the housing 23 contains a brushless electric motor 26 fitted with a speed-reducing gearbox and with a sensor responsive to the absolute angular position of the shaft of the motor or of the outlet shaft of the gearbox.

The motor 26, the angular position sensor that is associated therewith, and an electronic power supply module connected to the motor and to the sensor together form a servo-motor making it possible at all times to know the position of the movable obstacle within the housing 21, thus making it possible, where appropriate, to avoid using additional sensors in order to monitor the movement of the obstacle.

Figure 1:
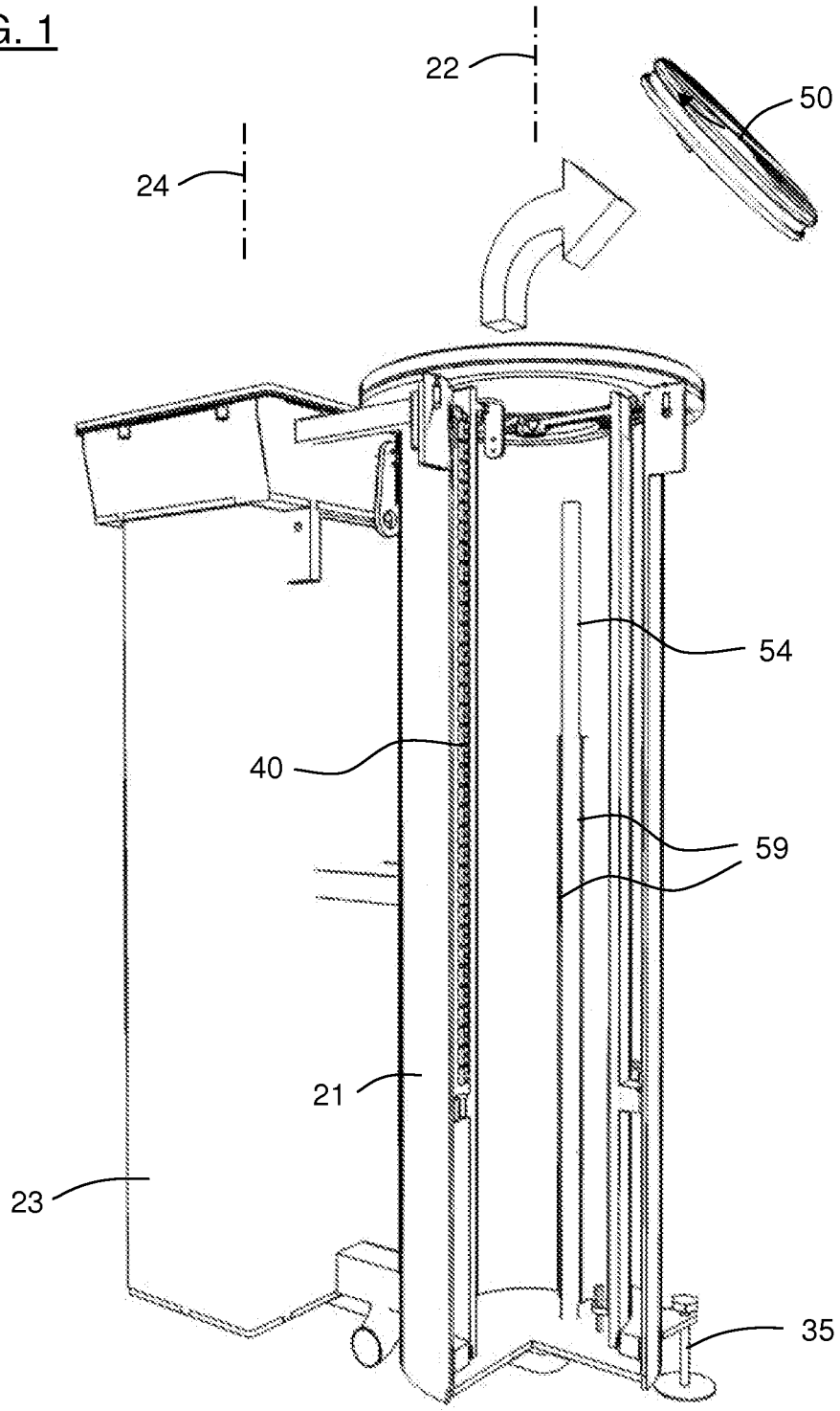
FIG. 1 is a cutaway diagrammatic perspective view showing two housings of an access control device.

The device 20 also includes two buried ducts 31 that extend between the two housings. Each duct 31 serves as a protective covering for a force-transmission chain connecting the bollard to the motor, and it extends from an opening provided in the wall of the housing 21 to an opening provided in the wall of the housing 23. In FIG. 1, it can be seen that each covering duct 31 opens out substantially tangentially into the housing 21.

The housings 21 and 23 are buried in the ground so that their respective top ends are substantially flush with the surface of the ground, and so that they are spaced apart by a distance 34, which distance may be of the order of 10 centimeters (cm) or 20 cm, for example.

To this end, a pit 29 is dug in the ground, and a mud slab made of concrete may be cast in the bottom of the pit. The housings may be placed on the slab, and their respective longitudinal axes may then be made vertical by acting on screw jacks—or other legs of adjustable length—such as those referenced 35 in FIGS. 1 to 3. This also makes it possible to ensure that the parts covering the top ends of the housings are horizontal (which parts are referenced 48 and 49 in FIG. 8).

A cage 30 of metal reinforcing bars surrounding the housings may be put into the pit prior to the pit being filled with concrete 33. The layer of concrete that then extends in the space between the two housings forms a structure capable of damping impacts applied to the bollard and transmitted by the bollard to the housing 21, and by the housing 21 to this layer of concrete, such that the access control device is capable of withstanding considerable impacts without damaging the members situated in the second housing 23.

The device 20 also includes a cabinet 27 housing the members necessary for powering the motor electrically and for controlling the movement of the retractable bollard 25 as a function of signals delivered by the angular position sensor fitted to the motor-and-gearbox unit, the cabinet 27 being connected to the motor 26 by means of cables 28.

The cabinet 27 includes in particular a backup power supply 32 comprising a battery and an inverter.

Figure 2:
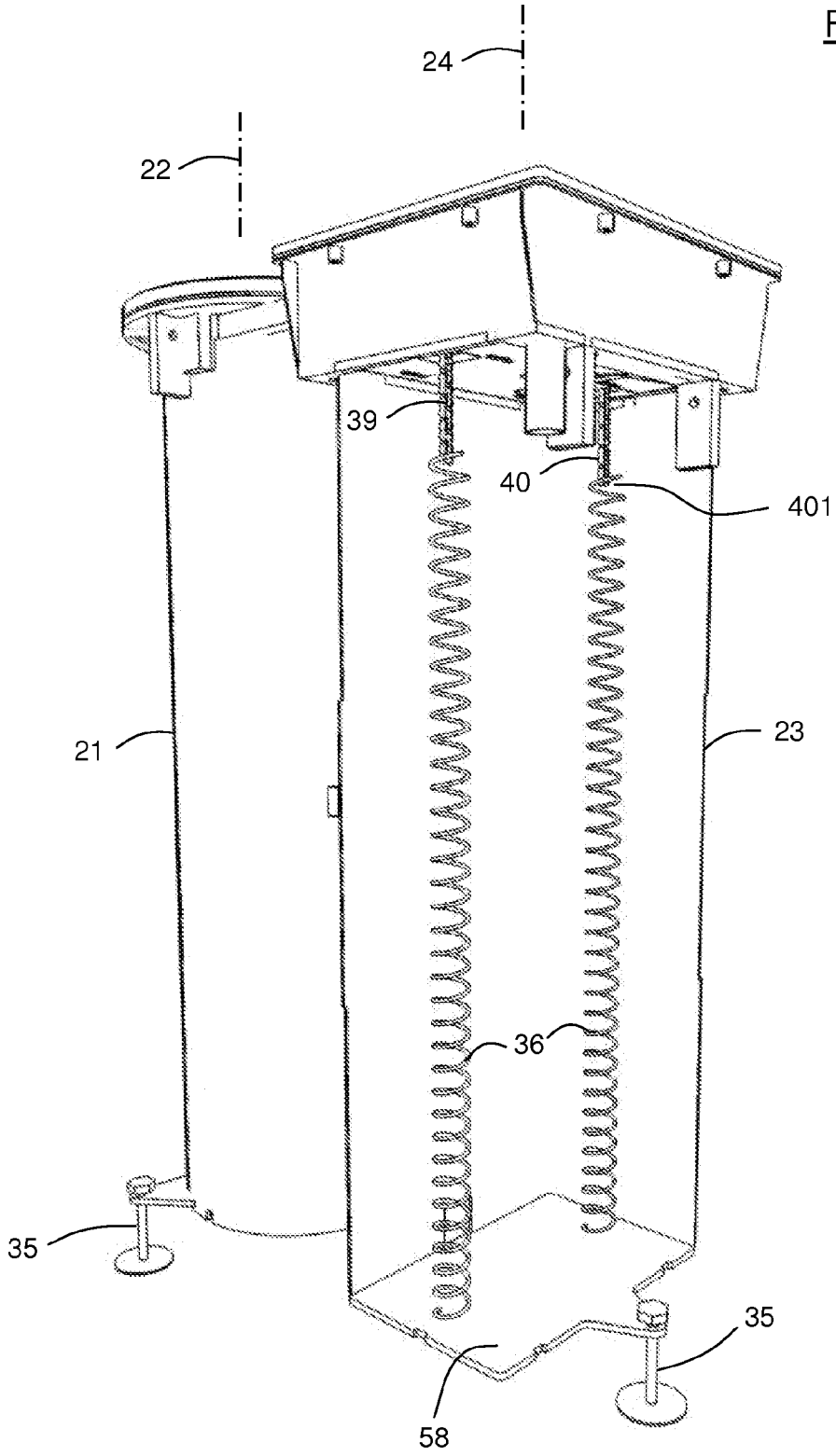
FIG. 2 is a cutaway diagrammatic perspective view seen from a different viewing angle showing the two housings of an access control device, this figure showing two tensioned springs of a return device provided in one of the housings.
Figure 3:
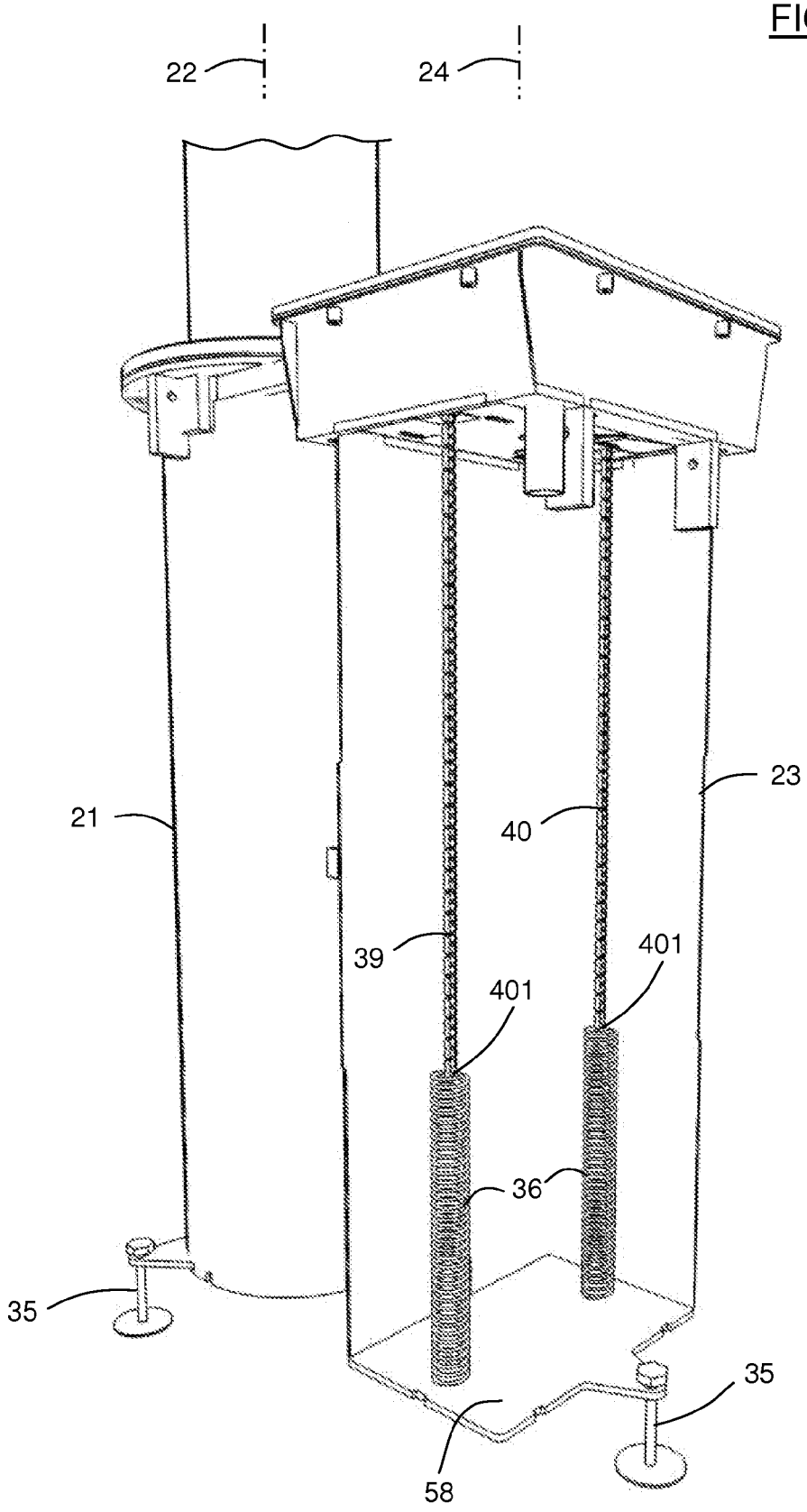
FIG. 3 is a diagrammatic perspective view seen from the same viewing angle as FIG. 2, showing the two housings of the FIG. 2 device in a configuration corresponding to the obstacle being deployed out from the first housing, in which position the springs of the return device are shortened ("relaxed").

In the embodiments of the access control device shown in FIGS. 2 and 3, the mechanical return device for returning the obstacle to a position projecting out from the first housing is constituted by two helical springs 36, whereas in the embodiments shown in FIGS. 4 to 7 and 9, the mechanical return device is constituted by two heavy structures 37 and 38 in the form of rectangular blocks.

Figure 8:
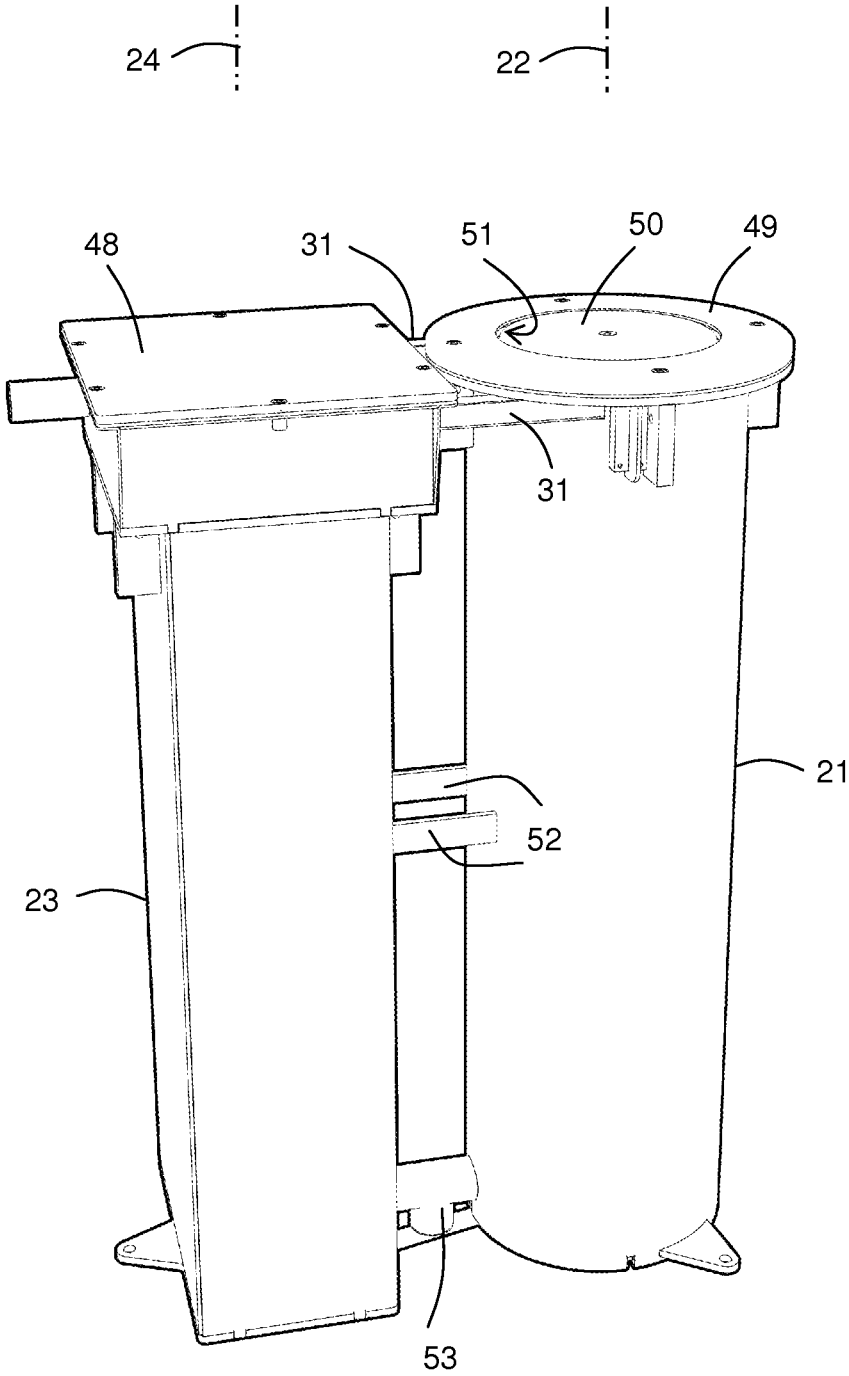
FIG. 8 is a perspective view of the housings of an access control device in a retracted configuration of the obstacle.

With reference to FIG. 8 in particular, the top end of the housing 23 is closed by a cover 48 giving access to the members contained in this housing.

A ring 49 is releasably fastened to the top end of the housing 21 and defines a circular opening 51 allowing the cylindrical body of the retractable obstacle 25, 50 to pass through with a small amount of clearance.

The covering ducts 31 and the spacers 52 connecting the housings 21 and 23 together enable the two housings to be handled simultaneously in order to place them in a pit.

A T-shaped duct 53 interconnects the bottom ends of the housings and enables them to be connected to a pipe (not shown) for draining away any liquid that might penetrate into the housings.

Figure 4:
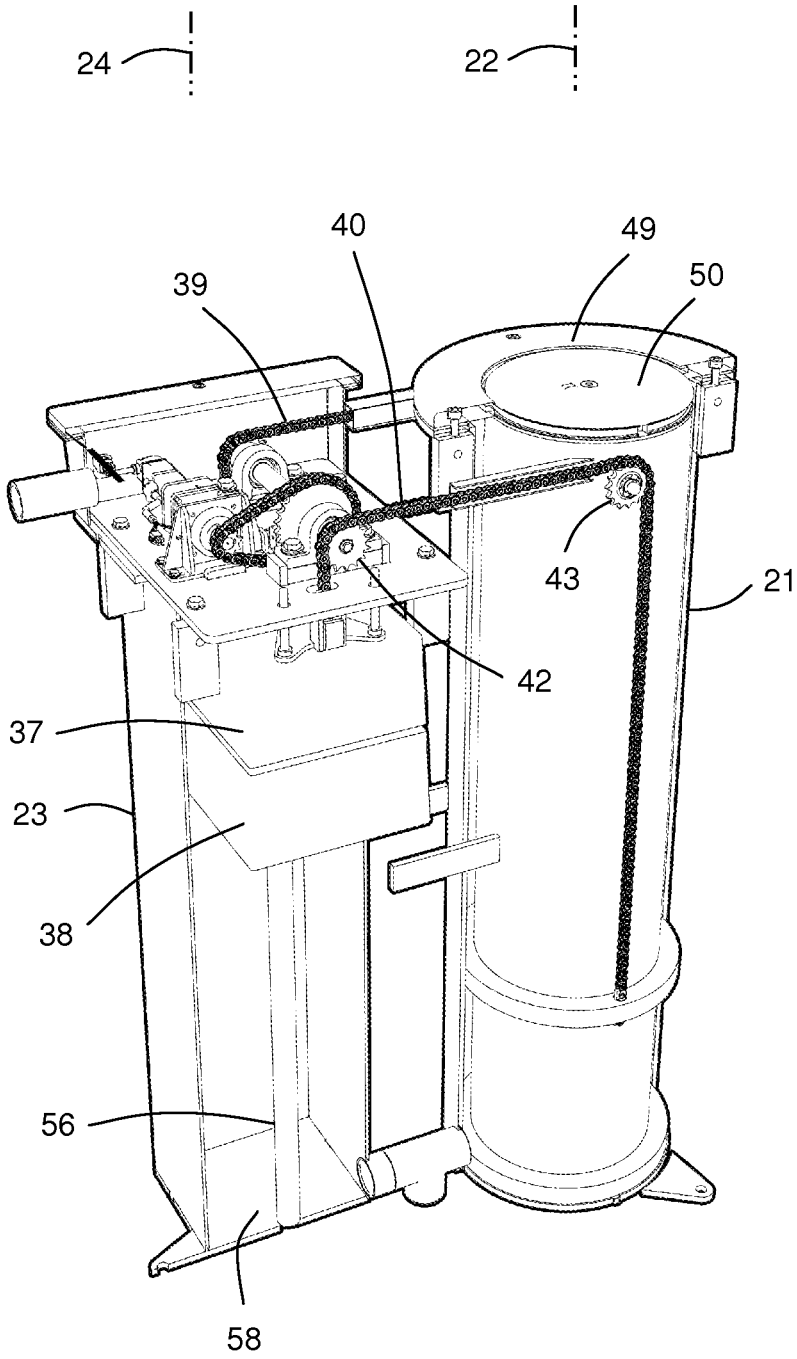
FIGS. 4 to 6 are diagrammatic perspective views from the same viewing angle and cut away to show the components within the housings, these views showing the housings and the deformable links of an access control device in three distinct configurations of the access control device.
Figure 5:
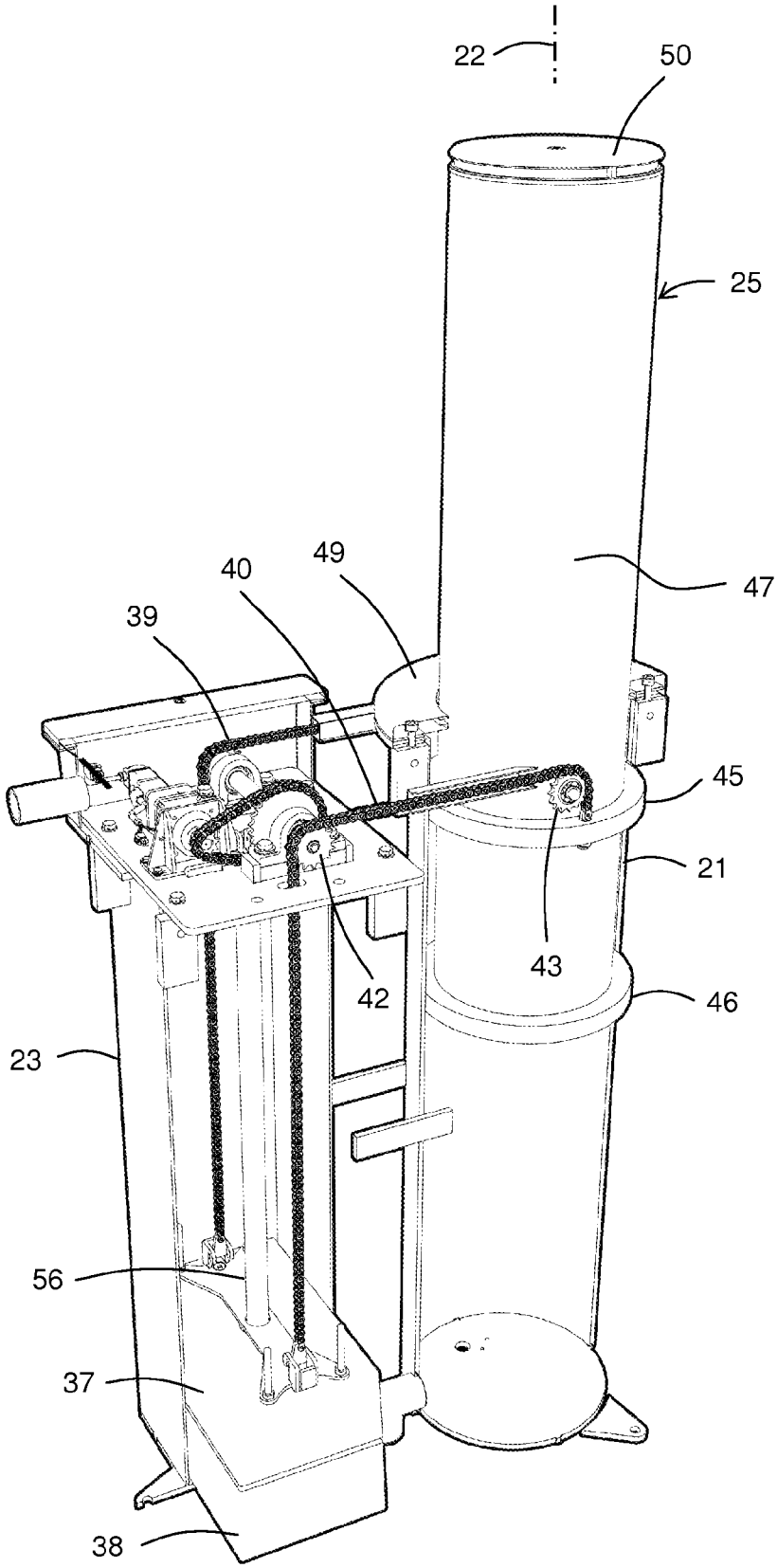
Figure 6:
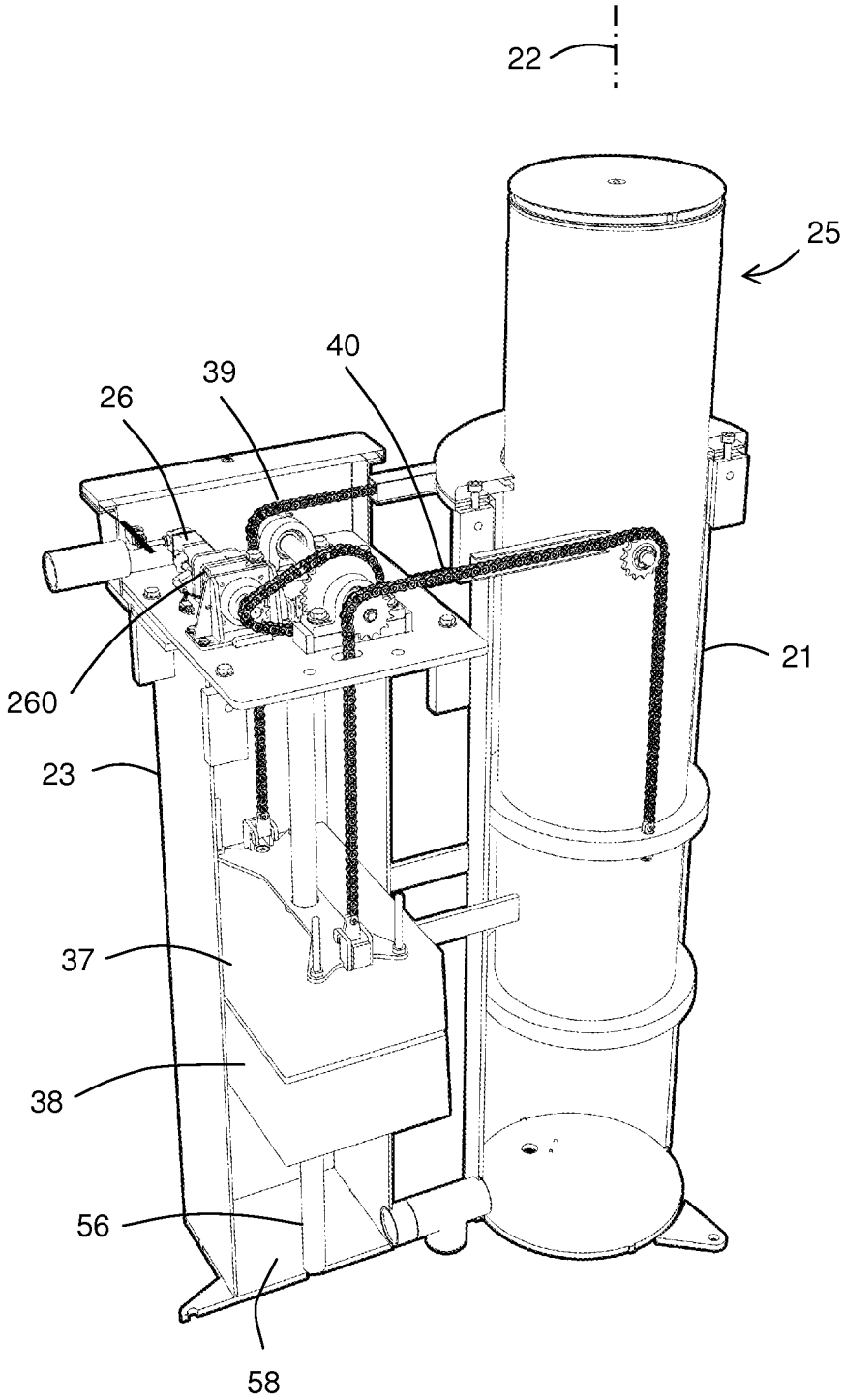
Figure 7:
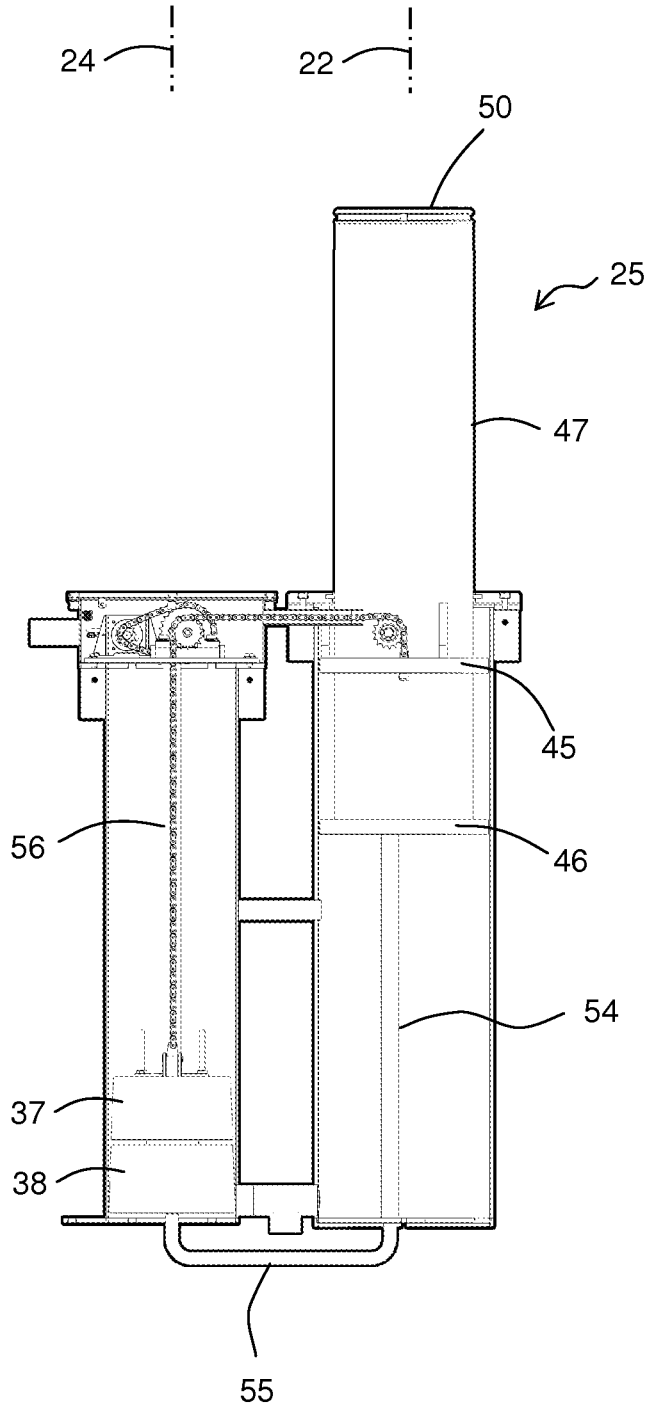
FIG. 7 is a cutaway side view of an access control device in a maximally-deployed configuration of the obstacle.

With reference to FIGS. 4 to 6 in particular, the retractable bollard 25 comprises a cylindrical body 47 of circular section and of longitudinal axis that substantially coincides with the axis 22 of the housing 21, with the bollard sliding along this axis in the housing.

The body 47 is closed at its top end by a disk-shaped end wall 50, which wall is fastened to the body 47 in removable manner as shown diagrammatically in FIG. 1. The edge face of the disk 50 may be provided with a groove that receives a flexible printed circuit fitted with light-emitting diodes (LEDs) (not shown) for providing light to indicate the presence of the bollard.

These LEDs are powered by the cabinet 27 (FIG. 10) by means of a cable (not shown) that is suspended from the end wall 50 and that runs along a duct having three portions that are connected together end to end: i) a rigid rectilinear portion 54 (FIGS. 1, 7, and 9) extending vertically from the bottom end 57 of the housing 21; ii) a rectilinear portion 55 (FIG. 7) with a bend at each end and extending beneath the housings 21 and 23; and iii) another rigid rectilinear portion 56 (FIGS. 6, 7, and 9) extending vertically from the bottom end 58 of the housing 23 to the top portion of the housing that houses the bollard drive mechanism.

With reference to FIGS. 4 to 6 and 9 in particular, the bottom end of the body 47 of the bollard 25 is surrounded by a flange 46 serving to reinforce the tube 47 and to guide its movement in the housing 21. For this purpose, the outside diameter of the flange 46 is slightly less than the inside diameter of the housing 21, such that the flange 46 slides together with the body 47 while leaving small clearance relative to the housing 21.

The bollard 25 has a second flange 45 similar to the first flange 46, located above the flange 46, and carrying or including an anti-friction member or coating on its outer edge face, e.g. constituted by polytetrafluoroethylene.

The flanges 45 and 46 thus serve to guide the bollard as it slides inside the housing 21, and also to transmit forces that need to be withstood by the body of the bollard in the event of an impact against it, the forces being transmitted from the body of the bollard to the wall of the housing 21.

Generally, the housings 21 and 23 and the elements 45 to 47 and 50 of the movable bollard 25 are made of metal, with the wall thickness of the housings being less than the wall thickness of the bollard body.

As can be seen in FIG. 1, the inside face of the bollard body is provided with two longitudinal fins 59 that extend close to and on either side of the duct 54 so that the duct prevents the bollard 25 from turning inside the casing 21.

Furthermore, as can be seen in FIGS. 4 to 6, the duct 56 also serves to guide blocks 37 and 38 that are mounted to move in translation inside the housing 23.

In the embodiments of the access control device shown in FIGS. 2 to 7, in particular, the force transmission system connecting the movable obstacle 25 to the mechanical return device 36 to 38 and to the motor 26 is constituted by two identical chains 39 and 40 that extend substantially in two respective vertical planes that are parallel to the plane containing the longitudinal axes 22 and 24 of the housings 21 and 23.

Each of these chains, such as the chain 40, is fastened at one of its ends 401 to an attachment part 41 secured to the block 37, and is engaged with the teeth of a drive sprocket 42, and with the teeth of a deflector sprocket 43. The chain 40 is also fastened via its second end 402 to an attachment part 44 secured to the flange 45 surrounding the body 47 of the movable bollard.

Each of the two deflector sprockets 43 is arranged in the space defined by the wall of the housing 21 and by the body 47 of the bollard. The two sprockets 43 are fastened to the housing 21 and they are mounted to rotate freely relative to the housing about a common axis of rotation that is horizontal and perpendicular to the plane containing the axes 22 and 24 of the housings 21 and 23.

Figure 9:
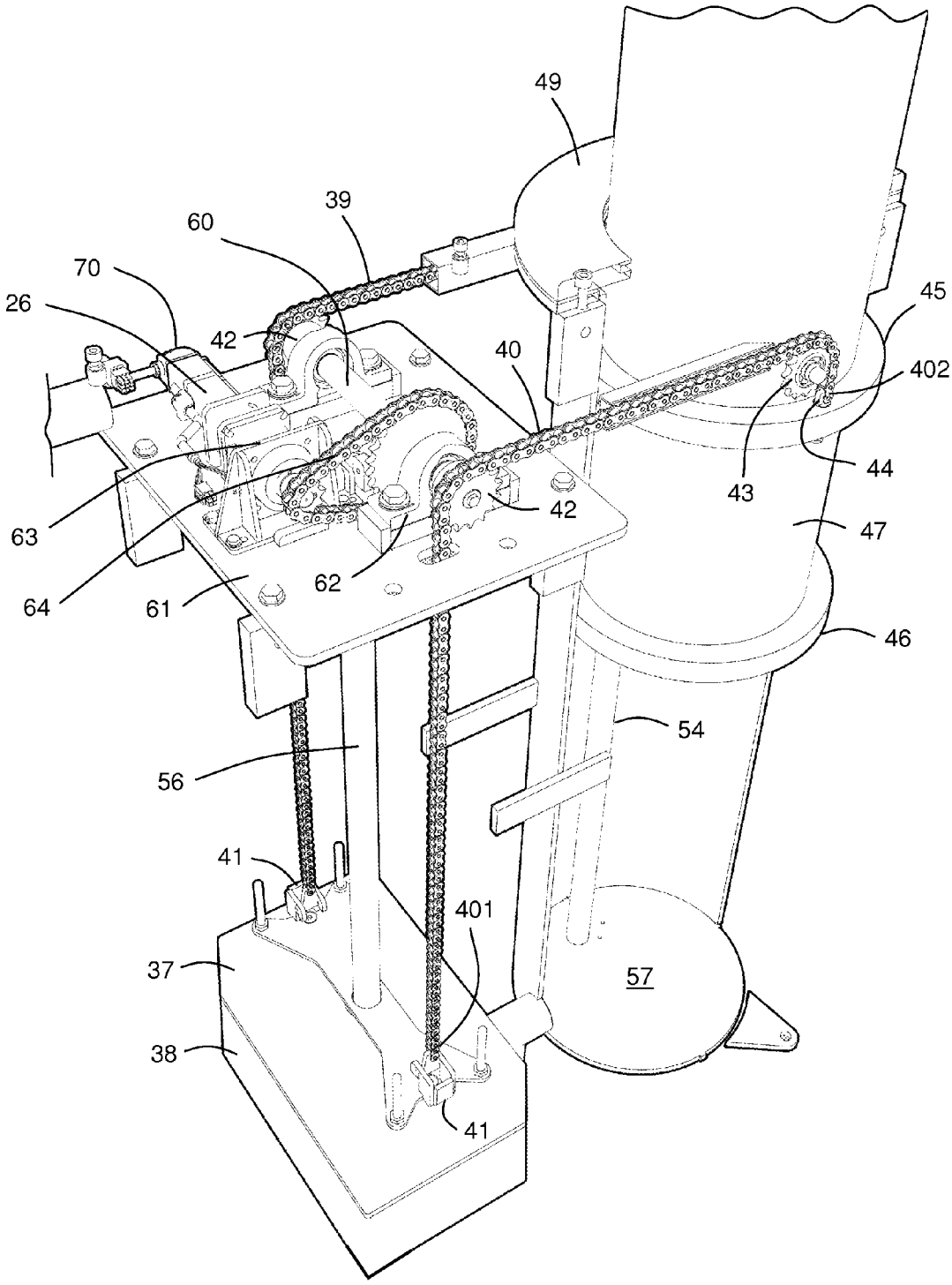
FIG. 9 is a perspective view from a viewing angle similar to that of FIG. 5 and on a larger scale, showing the arrangement of the main components of the system for driving and balancing the movable obstacle.

As shown in particular in FIG. 9, the two drive sprockets 42 are mounted at respective ends of a shaft 60 that is supported on a plate 61 by two bearings 62.

The axis of rotation of the shaft 60, and of the sprockets 42, is parallel to the common axis of rotation of the deflector sprockets 43.

The shaft 60 is driven in rotation by the motor 26 via a speed-reducing gearbox 63 coupled to the outlet shaft of the motor, via a sprocket fitted to the outlet shaft of the gearbox 63, and via a chain 64 engaged with the teeth of said sprocket and with the teeth of another sprocket mounted on the shaft 60.

Thus, rotation of the motor 26 in a first direction of rotation, starting from the retracted position of the bollard as shown in FIG. 4, in particular, causes the bollard 25 to be raised out from the housing 21, as shown in FIG. 6, until it reaches its maximally-deployed position as shown in FIG. 5, in which position the top flange 45 of the bollard is close to the top end of the housing 21.

Conversely, rotation of the motor 26 in a second direction of rotation opposite to the first causes the bollard 25 to be retracted progressively into the housing 21.

With reference to FIGS. 2 and 3, the mechanical return device for returning the obstacle comprises two identical helical springs 36 extending substantially vertically beneath the plate supporting the drive means for driving the force transmission chains.

A first end of each spring 36 is fastened to the end wall 58 of the second housing 23, and a second end of each spring is fastened to one end 401 of a respective one of the chains 39 and 40.

The presence of the counterweight and/or spring return device enables a low-power motor 26 to be used for moving the bollard 25, which may present a weight that is as great as or greater than 100 kilograms (kg) to 200 kg.

Positioning the drive and transmission means separately, in the independent housing 23 that is reinforced by a concrete structure makes it possible to protect the entire system effectively against any type of impact that may be suffered by the bollard 25. The separate positioning also presents the advantage of enabling a large majority of the components of the device to be acted on without extracting the movable bollard 25 from the housing 21.

The absence of any wear parts or parts exposed to impacts in and on the movable bollard 25 greatly minimizes the amount of preventative and corrective maintenance that is needed.

The reinforcing flanges 45 and 46 situated around the bollard 25 and sliding flush with the wall of the housing 21 make it possible for the forces that are caused by impacts produced by vehicles to be dissipated effectively within the concrete structure 33 surrounding the housings 21 and 23.

As described above, the bollard 25 is extended and retracted by a transmission having two chains 39 and 40, with each chain being suspended by two sprockets 42 and 43. One end of the chains may be fastened to the movable bollard 25, and the other to a load 37, 38 of weight that may vary automatically as a function of electrical signals powering a connection member that operates electromagnetically and that connects together the two loads 37 and 38, thereby making it possible to ensure reference positioning as selected by the operator (bollard raised or bollard lowered).

The use of chains 39, 40, 64 for transmitting forces for raising the bollard and for driving the movement of the bollard provides efficient transmission and a high level of mechanical strength. The use of low maintenance or "maintenance-free" chains such as those available from the supplier Sedis (France) under the name "Chaîne verte®)" can make greasing unnecessary.

The use of a servo-motor 26 fitted with an absolute coder (referenced 70 in FIG. 9) enables accurate positioning for the body of the bollard in the housing 21 to be transmitted to a bollard control system, and makes it possible to move the bollard in application of a trajectory (which may be defined in terms of a speed, an acceleration, and a "target" point) that is programmed or recorded in an electronic card for controlling the servo-motor.

The movement of the bollard may be stopped so as to position it at a predefined point, so that there is no need to use additional movement sensors. This also makes it possible to provide an access control device in which the maximum height of the projecting portion of the bollard is variable.

The bollard may be locked in position by maintaining motor torque that may increase or decrease automatically as a function of the force applied to the bollard in the event of an unauthorized attempt at making it retract. Thus, there is no need to use an electrically operated brake or other locking device.

The speed of rotation of the servo-motor may reach 6000 revolutions per minute (rpm) with accelerations that are high, so as to guarantee that the bollard 25 moves quickly, e.g. in order to block access in the event of an alarm being triggered.

The counterweight 37, 38 may be made up of two loads that are connected together by an electromagnet that either passes or does not pass electric current. Thus, depending on the desired application, it is possible to vary the weight of the counterweight.

Using a counterweight that is heavier than the movable bollard enables the bollard to be raised and held in its high position without requiring electrical energy to be expended.

Using a counterweight enables the bollard to be accompanied while it is descending, avoiding the bollard dropping suddenly, thereby making it possible to reduce the power of the motor 26 and to reduce its energy consumption, and it also makes it easier to use an electrical power supply for the motor based on an inverter and capable of ensuring uninterrupted service in the event of a power cut (and for a duration that varies as a function of the capacity of the battery of the inverter), capable of blocking the bollard in its high position, and capable of retracting the bollard into its low position and keeping it in that position.

The surface of the cylindrical body of the retractable bollard 25 may be protected and decorated by installing a sticky translucent film (not shown) on the outside face thereof.

The nature of the film may be selected to be capable of withstanding attack from the environment of the bollard (moisture, sand, impacts, etc.).

The inside face of the film may be silkscreen-printed and may include "trompe l'oeil" patterns for modifying the visual appearance of the body of the bollard (i.e. modifying its surface appearance and shape), e.g. giving it the appearance of a ("Roman") sculptured column with a granite or marble look.

The film may be coated in adhesive and may benefit from anti-scratch treatment.

The film may be a flexible transparent polyester film coated in acrylic adhesive.

In addition to withstanding abrasives, ultraviolet radiation, bad weather, and chemicals, such films are capable of adhering in particular on a bollard body made of steel, regardless of whether or not it is painted, and they enable the bollard body to be decorated and to be cleaned easily (in particular for graffiti).

The possibility of unsticking such a film once it has deteriorated and of replacing it with an identical new film makes the body of the bollard easier to maintain.

The invention claimed is:

1. An access control device (20) comprising a first housing (21), an obstacle (25) mounted to move in translation in the first housing, a second housing (23) receiving an electric motor-and-gearbox unit (26), and a deformable link connected to the obstacle and co-operating with the motor gearbox unit, the device being characterized in that the second housing is spaced apart (34) from the first housing, and in that the access control device has a mechanical return device (36 to 38) for returning the obstacle towards a projecting position outside the first housing, which device is connected to the deformable link and is arranged in the second housing.

2. A device according to claim 1, including at least one hollow structure (31) extending between the first and second housings with a portion of the deformable link extending therein.

3. A device according to claim 1, including a power supply (32) for powering the electric motor, which power supply includes an electrical energy storage device such as a battery.

4. A device according to claim 1, having two deformable links (39, 40) each fastened to the movable obstacle at a first one of its ends (402), each fastened to the mechanical return device at a second one of its ends (401), and each engaging a drive member (42) driven in rotation by the motor-and-gearbox unit.

5. A device according to claim 4, wherein the movable obstacle has a cylindrical body (47) of circular section, and the two deformable links are fastened respectively to the obstacle at two points or regions thereof that are diametrically opposite.

6. A device according to claim 1, wherein the movable obstacle has a tubular body (47) provided with at least one piece of reinforcement (45, 46) projecting from its outside face and extending over at least a substantial portion of a circumference of the tubular body, at a short distance from the inside face of the first housing.

7. A device according to claim 6, wherein the tubular body of the obstacle is provided with a first piece of annular reinforcement (46) arranged at the bottom end of the tubular body, and with a second piece of annular reinforcement (45) arranged above the first, and at a substantial distance therefrom, e.g. at a distance of the order of half the diameter or of the diameter of the tubular body.

8. A device according to claim 1, wherein the mechanical return device for returning the obstacle comprises a heavy structure (37, 38) acting as a counterweight for balancing at least a fraction of the weight of the movable obstacle.

9. A device according to claim 8, wherein the heavy structure presents a weight that is greater than the weight of the movable obstacle.

10. A device according to claim 8, wherein the heavy structure presents a weight that is less than the weight of the movable obstacle.

11. A device according to claim 8, wherein the heavy structure comprises two heavy sub-structures (37, 38) connected together by an electromagnetic connection member.

12. A device according to claim 1, wherein the mechanical return device for returning the obstacle comprises one or more springs (36), in particular one or more helical springs, with a first end fastened to the wall (58) of the second housing and with a second end fastened to one end (401) of a deformable link (39, 40).

13. A device according to claim 1, wherein the movable obstacle has a tubular body (47) and an end wall (50)—or cap—closing the top end of the tubular body and releasably fastened to the tubular body.

14. A device according to claim 1, wherein the housings are fitted with jacks (35) at their bottom portions.

15. An access control device (20) comprising a first buried housing (21), a bollard (25) slidably mounted in the first housing to slide along the substantially vertical longitudinal axis (22) of the housing, a second buried housing (23), a rotary electric motor (26) fitted with a reversible speed-reducing gearbox (63) and placed in the second housing, and a deformable link (39, 40) connected to the obstacle (25) and driven by the motor-and-gearbox unit (26, 63), the access control device being characterized in that the second housing is separated from the first housing by a dissipative structure (33) serving to reduce the amount of energy of an impact that is transmitted to a second housing, and in that it includes a hollow structure (31) connecting together the respective top portions of the first and second housings and within which a portion of the deformable link can extend and move, together with a mechanical return device (36 to 38) for returning the obstacle towards a position projecting out from the first housing, the mechanical return device being connected to the deformable link and being arranged in the second housing.

16. A device according to claim 15, wherein the dissipative structure comprises concrete.

17. A device according to claim 15, including a power supply (32) for powering the electric motor, which power supply includes an electrical energy storage device such as a battery.

18. A device according to claim 15, having two deformable links (39, 40) each fastened to the movable obstacle at a first one of its ends (402), each fastened to the mechanical return device at a second one of its ends (401), and each engaging a drive member (42) driven in rotation by the motor-and-gear-box unit.

19. A device according to claim 18, wherein the movable obstacle has a cylindrical body (47) of circular section, and the two deformable links are fastened respectively to the obstacle at two points or regions thereof that are diametrically opposite.

20. A device according to claim 15, further including a translucent film covering at least a portion of the outside surface of the bollard and secured to the bollard in releasable manner, in particular by adhesive.

* * * * *